US005400601A

United States Patent [19]

Germain et al.

[11] Patent Number: 5,400,601

[45] Date of Patent: Mar. 28, 1995

[54] PROCESS AND DEVICE FOR THE DISTRIBUTION OF QUANTITIES OF LIQUID, PARTICULARLY LIQUEFIELD GAS

[75] Inventors: Jean-Pierre Germain, Montigny-Le-Bretonneux; Cornelis Klok, Noiseau, both of France

[73] Assignee: L'Air Liquide, Societe Anonyme Pour l'Etude et l'Exploitation des procedes Georges Claude, Paris, France

[21] Appl. No.: 120,924

[22] Filed: Sep. 15, 1993

[30] Foreign Application Priority Data

Sep. 29, 1992 [FR] France ..... 92 11575

[51] Int. Cl.[6] ..... F17C 9/00

[52] U.S. Cl. ..... 62/50.1; 62/50.2; 62/50.4; 62/78; 141/64

[58] Field of Search ..... 62/50.1, 50.2, 50.4, 62/51.1, 60, 47.1, 49.1, 78; 141/63, 64, 70, 115, 126

[56] References Cited

U.S. PATENT DOCUMENTS

| | | | |
|---|---|---|---|
| 4,220,312 | 9/1980 | Pauliukonis | 62/50.2 X |
| 4,489,767 | 12/1984 | Yamada | 141/48 |
| 4,499,931 | 2/1985 | Urban | 141/67 |
| 4,523,433 | 6/1985 | Takahashi et al. | 62/60 |
| 4,546,609 | 10/1985 | Roullet et al. | 62/51.1 X |
| 4,662,154 | 5/1987 | Hayward | 141/64 X |
| 4,805,806 | 2/1989 | Smith | 62/50.4 X |
| 5,169,031 | 12/1992 | Miller | 62/50.2 X |
| 5,272,881 | 12/1993 | Lee | 62/50.4 |

FOREIGN PATENT DOCUMENTS

| | | | |
|---|---|---|---|
| 0109134 | 5/1984 | European Pat. Off. . | |
| 0252312 | 1/1988 | European Pat. Off. . | |
| 0271031 | 6/1988 | European Pat. Off. | 62/49.1 |
| 4036421 | 5/1992 | Germany | 141/64 |
| 146797 | 9/1983 | Japan | 62/50.1 |
| 0203296 | 11/1983 | Japan | 62/47.1 |
| 37399 | 2/1984 | Japan | 62/50.1 |
| 59-106798 | 6/1984 | Japan . | |
| 106799 | 6/1984 | Japan | 62/50.1 |
| 139313 | 5/1990 | Japan | 141/64 |

*Primary Examiner*—Christopher Kilner
*Attorney, Agent, or Firm*—Young & Thompson

[57] ABSTRACT

Quantities of liquid are distributed via a conduit (5) connected to a source (4) of the liquid, by periodically opening and closing a closure member (7) disposed in the conduit, and injecting, during a predetermined period, immediately after the 5 closing of the closure member (7), a quantity of gas into the conduit portion (6)immediately downstream of the closure member. The duration of the cycle between two successive openings of the closure member (7)is less than 0. 1 second. The liquid is an inert liquefied gas, e.g. nitrogen or argon. The injected gas is the same as the liquefied gas and comes from a same cryogenic receptacle (1). The invention is useful for rendering inert or pressurizing containers of food products.

13 Claims, 1 Drawing Sheet

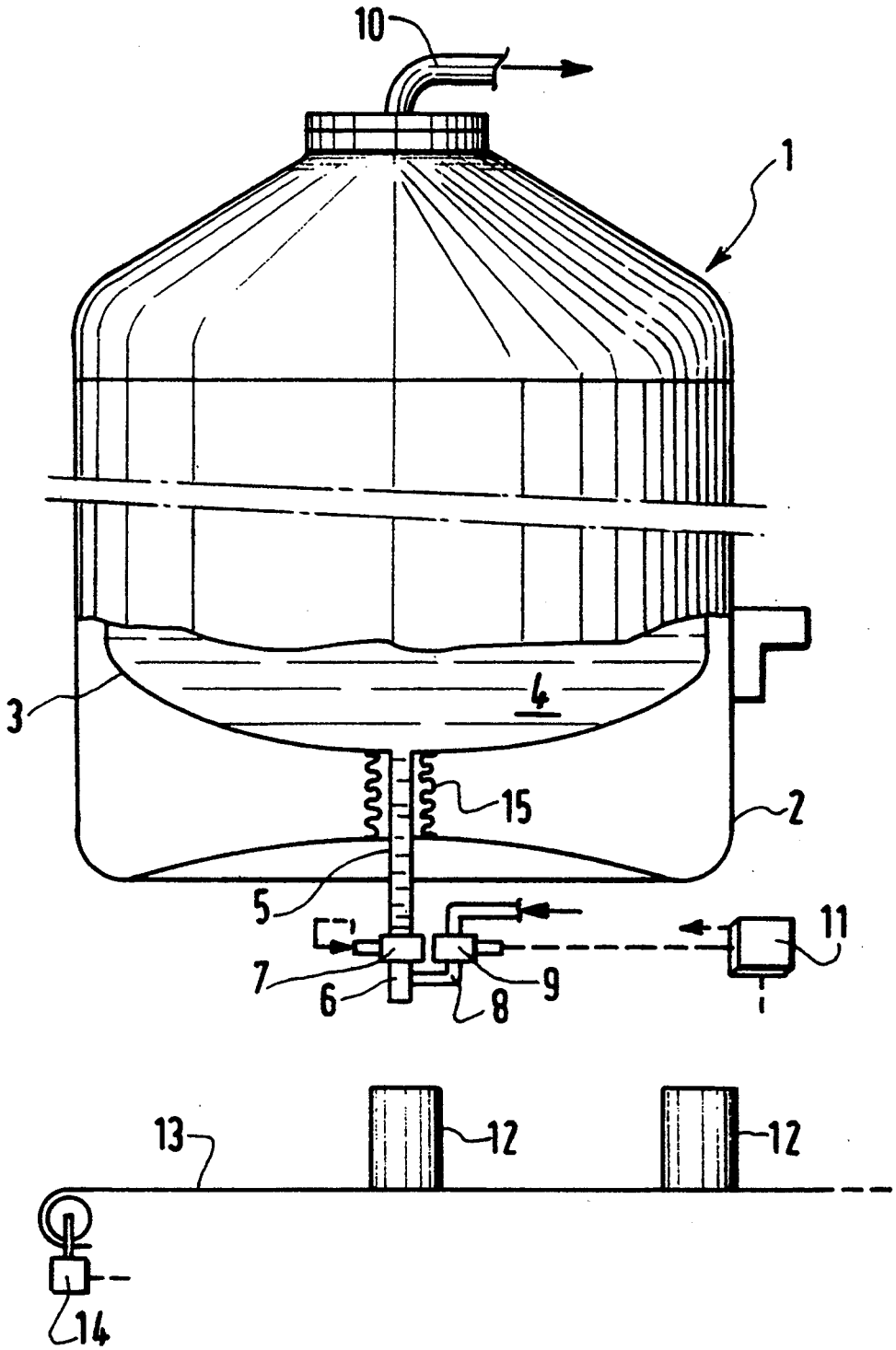
10
1
3
4
15
2
5
11
7
6
8
9
13
12
12
14

PROCESS AND DEVICE FOR THE DISTRIBUTION OF QUANTITIES OF LIQUID, PARTICULARLY LIQUEFIELD GAS

BACKGROUND OF THE INVENTION

The present invention relates to processes for the distribution of quantities of liquid via a conduit connected to a source of said liquid, comprising the steps of periodically opening and closing a closure member disposed in the conduit, particularly to introduce quantities of liquefied inert gas into the containers of food products.

SUMMARY OF THE INVENTION

The present invention has for its object the provision of an improved process of the above type, of low cost to practice, permitting delivering, in a reliable manner, precise quantities at high frequency and to overcome particularly the problems frequently encountered with drops at the outlet of the distribution conduit.

To do this, according to a characteristic of the invention, the process comprises the steps of injecting during a predetermined period, immediately after the closing of the closure member, a quantity of gas into the conduit portion immediately downstream of the closure member.

According to other particular characteristics of the invention:

- the duration of the cycle between two successive openings of the closure member is less than 0.1 second, particularly of the order of 0.05 second;
- the liquid is a liquefied gas, typically nitrogen, argon or a mixture of the two;
- the injected gas is the same as the liquefied gas, the gas in liquid and gaseous phases preferably emanating from a same cryogenic receptacle.

The present invention has for another object to provide a distribution device for quantities of liquid in a distribution conduit connected to a source of liquid and comprising a closure means, characterized in that it comprises a gas conduit connected to a source of gas under pressure and opening into the conduit, immediately downstream of the closure means, and comprising a valve actuated in sequence with the closure means.

The present invention also relates to the use of the above process and device for rendering inert or pressurizing containers of food products, particularly containers of preserves or receptacles for non-carbonated beverages.

BRIEF DESCRIPTION OF THE DRAWINGS

Other characteristics and advantages of the present invention will become apparent from the following description of an embodiment, given by way of illustration but in no way limiting, with respect to the accompanying drawing, in which:

The single FIGURE shows schematically a device for the distribution of quantities of inert liquefied gas according to the invention.

DETAILED DESCRIPTION OF THE INVENTION

In the single figure, there will be seen a cryogenic reservoir 1 comprising, in a conventional manner, an external shell 2 and, thermally insulated from this latter, an internal shell 3 defining an internal chamber for the storage of a quantity of liquefied gas 4 surmounted by a gaseous sky, The device comprises a distribution conduit comprising an upstream portion 5 opening into the internal shell 3 and a short downstream or distribution portion 6 separated by a cryogenic electrovalve 7. Into the downstream portion 6, immediately downstream of the electrovalve 7, opens a gas conduit 8 comprising an electrovalve 9 connected to a source of gas under pressure, preferably the gaseous phase of the cryogenic liquid in the reservoir 1, available via a conduit 10 communicating with the gaseous sky of the internal shell 4 or, as the case may be, with an internal vaporization coil for the liquefied gas 4. The electrovalves 7 and 9 are connected to an electronic control unit 11. The assembly of the reservoir 1 and of the distribution system of liquid quantities is disposed above the path of receptacles 12 constituted typically by a conveyor 13 moved by controlled drive means 14.

The cycle of operation of the device which has been described is as follows: the electrovalve 7 is opened for a predetermined duration, typically of the order of several hundredths of a second, to let flow a measured quantity of the liquid contained in the upstream portion of the conduit 5 and to pour this predetermined quantity into a receptacle 12 passing beneath the downstream portion 6 of the distribution conduit. The electrovalve 7 is then closed and, a very short time following, of the order of ten one-thousandths of a second, the electrovalve 9 is opened, for a predetermined period, typically of the order two one-hundredths of a second, to sweep the downstream portion 6 of the distribution conduit and thereby to expel the drops of liquid located in the downstream portion 6. The duration of opening of the electrovalve 9 also permits adjusting the quantity of liquid transferred into the receptacle 12 by vaporizing a portion of the liquid admitted in the downstream portion 6 during opening of the electrovalve 7. The opening of the electrovalves 7 and 9 is adjustable as a function of the size of the receptacles 12 and their provision is synchronized, via the control unit 11, by signals of the detection of the presence of the receptacles 12 and/or of the speed of advance of these latter. In mass production, the total duration of a cycle can be reduced to 0.05 second.

According to one aspect of the invention, particularly for the distribution of quantities of liquid nitrogen, the upstream portion 5 of the distribution conduit is directly connected to the bottom of the internal shell 3 extending through a passage formed by a tubular sleeve 15 sealingly connecting the bottoms of the internal and external shells 3 and 2, and constituted for example by a metallic bellows. According to the environment of the device, the electrovalves 7 and 9 can be disposed in an insulating housing.

Although the present invention has been described with relation to a particular embodiment, it is not thereby limited but on the contrary is susceptible to modifications and variations which will be apparent to one skilled in the art.

What is claimed is:

1. A method of dispensing a quantity of a liquid via a conduit connected at one end to a source of said liquid and including an actuatable closure member upstream from a delivery portion of the conduit, comprising the steps of temporarily opening the closure member to deliver a quantity of liquid; subsequently closing the closure member; and, immediately after the closing of the closure member, injecting a flow of gas through the delivery portion.

2. The method of claim 1, wherein the quantity of liquid is delivered by gravity during the opening of the closure member.

3. Process according to claim 1, wherein the duration of the cycle between two successive openings of the closure member is less than 0. 1 second.

4. Process according to claim 1, wherein the liquid is an inert liquefied gas.

5. Process according to claim 4, wherein the injected gas is the same as the liquefied gas.

6. Process according to claim 5, wherein the gas in liquid and gaseous phases comes from a same cryogenic receptacle.

7. Process according to claim 4, wherein the liquefied gas is nitrogen.

8. Process according to claim 4, wherein the liquefied gas is dispensed into the top of a container of food product.

9. An apparatus for dispensing an amount of liquid comprising:

a distribution conduit having one end connected to a source of said liquid, an actuatable first closure member, and a downstream delivery portion;

a gas conduit having one end connected to a source of gas under pressure, an actuatable second closure member, and a downstream end discharging into the downstream delivery portion of the distribution conduit member; and control means for actuating sequentially the first and second closure member.

10. The apparatus of claim 9, wherein the distribution conduit is stationary.

11. Apparatus according to claim 9, wherein the first closure member is an electrovalve.

12. Apparatus according to claim 9, wherein the liquid source and the source of gas are constituted by a cryogenic reservoir containing a cryogenic fluid in liquid and gaseous phases.

13. Apparatus according to claim 12, wherein the reservoir comprises an internal shell and an external shell, an upstream portion of the distribution conduit opening into the bottom of the internal shell and extending freely within a passageway connecting the bottom of the internal shell and the bottom of the external shell.

* * * * *